US007908977B2

(12) United States Patent
Zak et al.

(10) Patent No.: US 7,908,977 B2
(45) Date of Patent: Mar. 22, 2011

(54) COOLER TABLE

(75) Inventors: Zvi Zak, Herzlia (IL); Dafna-Sarit Reis, Tel Aviv (IL)

(73) Assignee: Keter Plastic Ltd., Herzelyia (IL)

( * ) Notice: Subject to any disclaimer, the term of this patent is extended or adjusted under 35 U.S.C. 154(b) by 25 days.

(21) Appl. No.: 12/285,501

(22) Filed: Oct. 7, 2008

(65) Prior Publication Data

US 2009/0101046 A1 Apr. 23, 2009

Related U.S. Application Data

(60) Provisional application No. 60/960,940, filed on Oct. 22, 2007.

(51) Int. Cl.
*A47B 85/00* (2006.01)

(52) U.S. Cl. ..... 108/26; 108/24; 108/25; 62/258; 62/389; 312/229

(58) Field of Classification Search ..... 108/25, 108/26, 50.11; 312/312; 62/378, 381, 453, 62/258, 458

See application file for complete search history.

(56) References Cited

U.S. PATENT DOCUMENTS

| | | | | | |
|---|---|---|---|---|---|
| 1,412,198 | A | * | 4/1922 | Ruediger | 62/460 |
| 2,022,591 | A | * | 11/1935 | Everitt | 312/229 |
| 2,093,856 | A | * | 9/1937 | Wales | 62/258 |
| 2,895,311 | A | * | 7/1959 | Spalvins | 62/258 |
| 3,699,780 | A | * | 10/1972 | Gehrmann | 62/378 |
| 3,932,009 | A | * | 1/1976 | Zollinger | 312/312 |
| 4,023,379 | A | * | 5/1977 | Zevlakis | 62/258 |
| 4,848,091 | A | * | 7/1989 | Border | 62/3.2 |
| 5,025,639 | A | | 6/1991 | Thomas | |
| D329,151 | S | * | 9/1992 | Baer | D6/433 |
| 5,172,642 | A | * | 12/1992 | Iannuzzelli et al. | 108/25 |
| D376,068 | S | | 12/1996 | Coy | |
| 5,586,805 | A | * | 12/1996 | Rinehart | 297/188.09 |
| 6,745,702 | B2 | * | 6/2004 | Goldberg et al. | 108/26 |
| 2006/0191284 | A1 | * | 8/2006 | Fuller | 62/389 |

FOREIGN PATENT DOCUMENTS

| | | | |
|---|---|---|---|
| AU | 740406 | | 8/2001 |
| FR | 2 817 718 | A1 | 6/2002 |
| WO | WO 2006/046844 | A1 | 5/2006 |
| WO | WO 2007/054132 | A1 | 5/2007 |

* cited by examiner

*Primary Examiner* — José V Chen

(74) *Attorney, Agent, or Firm* — The Nath Law Group; William L. Klima; Jiaxiao Zhang

(57) ABSTRACT

A cooler table comprising a storage compartment formed with a top edge, and a tabletop. The tabletop is manipulable between a closed position in which it closes the top edge, and a table position in which it is mounted on a post extending from the storage compartment serving as a table while allowing access to the storage compartment.

21 Claims, 8 Drawing Sheets

COOLER TABLE

This application claims the benefit of prior U.S. provisional patent application No. 60/960,940 filed Oct. 22, 2007, the contents of which are hereby incorporated by reference in their entirety.

FIELD OF THE INVENTION

This invention relates to cooler tables of the type comprising a storage compartment and a tabletop.

BACKGROUND OF THE INVENTION

In the hospitality industry there is often a need to provide tables with integral storage space. Even more so, it is often required that such storage space be capable of cooling its contents or at least maintaining its temperature for a while, chilled or heated, by isolation from the environment. Such furniture is often used in garden or porch happenings, e.g. BBQ parties, receptions, etc., where tables or standing tables are provided (standing tables are referred to as tables attended to while standing or seated on bar chairs which are high chairs).

U.S. Pat. No. 4,848,091 discloses a portable refrigerated table-bar useful in the hospitality industry comprises an upright cylindrical cabinet having a tabletop, a centrally disposed dual tube arrangement for raising or lowering slidingly a pair of trays affixed thereto in spaced apart relation and a thermoelectric refrigerating unit disposed within the lower portion of the cabinet. The sliding movement of the trays is activated by electromechanical means associated therewith. One tray is provided with a plurality of depressions for accommodation of beverage bottles.

U.S. Pat. No. 5,025,639 discloses a patio table with a means for supporting an umbrella, incorporating a central thermally insulated container having access doors or the top surface of the table. The thermal container is cooled by an enclosure containing ice/chemical coolant or alternate refrigeration coils. A tubular member extends from the tabletop to a base structure of expanded area. The base structure has an enclosure for an alternate electric refrigeration unit.

U.S. Design Pat. No. D376,068 discloses a cooler tabletop.

SUMMARY OF THE INVENTION

The present invention is directed to a cooler container which is also a furniture article serving as a low table or a standing table.

According to the invention there is provided a cooler table comprising a storage compartment formed with a top edge, and a tabletop; said tabletop being manipulable between a closed position in which it closes said top edge, and a table position in which it is mounted on a post extending from said storage compartment serving as a table whilst allowing access to said storage compartment.

Any one or more of the following features may be applied to the invention subject of the present invention:

- the bucket-like storage compartment is thermally isolated.
- at the table position the tabletop extends at a height rendering the table a bar-type table (also known as a standing table).
- all components of the cooler table are receivable within the storage compartment when the tabletop is at the cover position.
- the storage compartment is fitted at a bottommost portion thereof with at least one drain port.

- the storage compartment is provided at its bottom with a drain port fitted with a movable sealing plug.
- the tabletop is provided with a top opening and an opposite opening on a bottom of the storage compartment and a drain channel extending therebetween.
- the drain channel extends trough the post.
- the storage compartment is double-walled to thereby form a thermally isolating space.
- the tabletop is mountable on an extendible post extending from the storage compartment. The post typically extends from an inside base of the storage compartment.
- the tabletop is mountable on an extendible central post extending from the storage compartment.
- the post is radially supported to side walls of the storage compartment.
- the post may be telescopically extendible or constructed from two or more detachably attachable segments.
- the post is constructed from two or more detachably attachable segments, wherein a first segment is integral with the storage compartment and extends to a height below the top edge of the storage compartment.
- the second segment is integral with the tabletop.
- the cooler table has a cylindrical structure and typically the components of the cooler table are coaxial.
- a plurality of support legs are detachably attachable to a bottom base of the storage compartment, for elevating the cooler table. It is appreciated that different types of legs may be provided, fixed, collapsible or detachable to a lower part of the storage compartment.
- the isolated bucket-like storage compartment is established of two coaxial shell-like members which at an assembled position define between them an air-isolation space. The shells may be secured to one another to form a solid member or may be detachable from one another. Optionally, the bucket-like storage compartment is a double-walled member so-formed in a molding process.
- a thermally isolating agent may be applied in said space, e.g. foamed material, thermal fiber, etc.
- the article is stackable over a like cooler table, wherein a base of a storage compartment of one cooler table fits over a tabletop of another cooler table.
- at the closed position, where the table top rests over the storage compartment, the article serves as storage compartment, a coffee table and is sufficiently durable for sitting thereon.

BRIEF DESCRIPTION OF THE DRAWINGS

In order to understand the invention and to see how it may be carried out in practice, several embodiments will now be described, by way of non-limiting examples only, with reference to the accompanying drawings, in which.

DETAILED DESCRIPTION OF EMBODIMENTS

Figure 1:
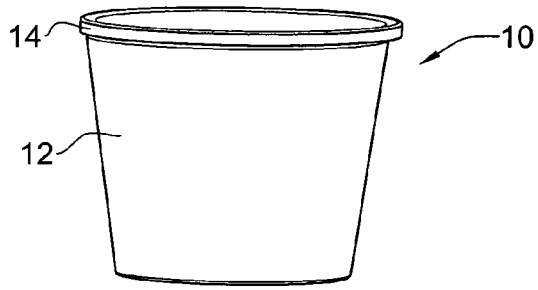
FIG. 1 is an isometric view of the cooler table at a fully collapsed, closed position in accordance with an embodiment of the present invention.

A cooler-table generally designated 10 is illustrated in FIG. 1 at a completely collapsed/stowed position and noticeable are only a bucket-like storage compartment 12 and a table top 14, which in this position serves as a cover for said storage compartment 12. At this position the table may be used for storing goods contained therein and as a sitting table.

Figure 2:
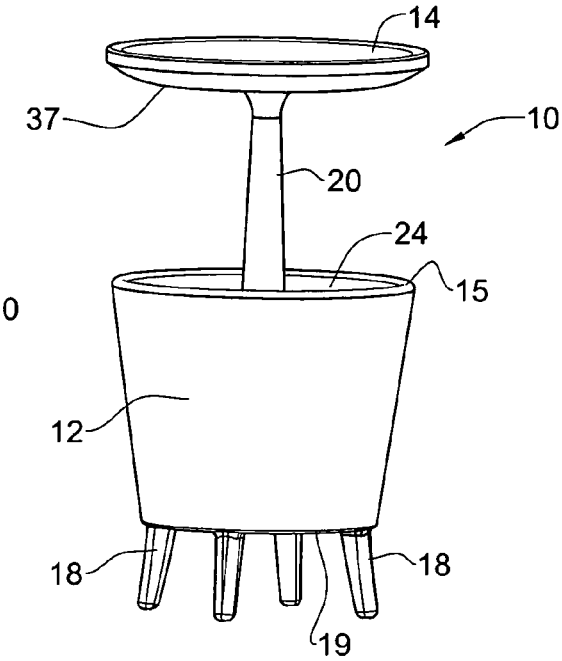
FIG. 2 is an isometric view of the cooler table at a fully open, standing table position in accordance with an embodiment of the present invention.

In FIG. 2 the cooler-table 10 is illustrated at a first, so-called table position, in a fully extended, fully erected position wherein the storage compartment 12 is mounted on four support legs 18 and the table top 14 is elevated from the storage compartment 12 and is supported spaced therefrom by means of support post 20, thus allowing access to the contents of the cooler received within the interior space 24. It is noted that at this position, namely the standing-table position, at times referred to also as a bar-table, the table top 14 extends at an elevation for conveniently standing by the table or sitting over a bar chair (an elevated chair).

Figure 4A:
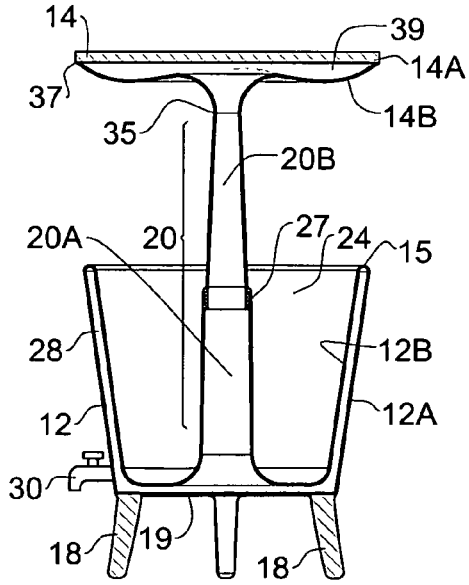
FIG. 4A is a sectioned view of the cooler table of FIG. 3.

The bucket-like storage compartment 12 is constructed of two shell-like members namely an external housing 12A and an internal liner 12B (e.g. best seen in FIGS. 4A, 6 and 7B) fixedly articulated to one another (e.g. by snap fitting or otherwise), defining between them a thermally isolated space 28 (e.g. best seen in FIG. 4A). It is noted that the storage compartment 12 may be a solid unit with the components 12A and 12B affixed to one another e.g. integrated during a molding process or otherwise adhered or fixed to one another thereafter and that the thermally isolated space 28 may be stuffed with a thermally isolating agent e.g. foamed material, thermal fibers, thermal gels, etc. Such stuffing further increases rigidity of the structure.

As can further be seen in FIG. 4A, at a lower part of the storage compartment 12 there is illustrated a draining port fitted with a faucet 30 for draining the interior of the storage compartment or for dispensing a liquid stored therein. The faucet 30 is optional and may be fitted at a later stage if a-priori provided there is an appropriate sealable faucet socket. This may be useful for storing a chilled/warm beverage to be dispensed through the faucet 30. According to an example of the invention, the cooler table is further provided with indicia (not shown) for indicating the amount of fluid contained within the storage compartment or dispensed therefrom.

Figure 12:
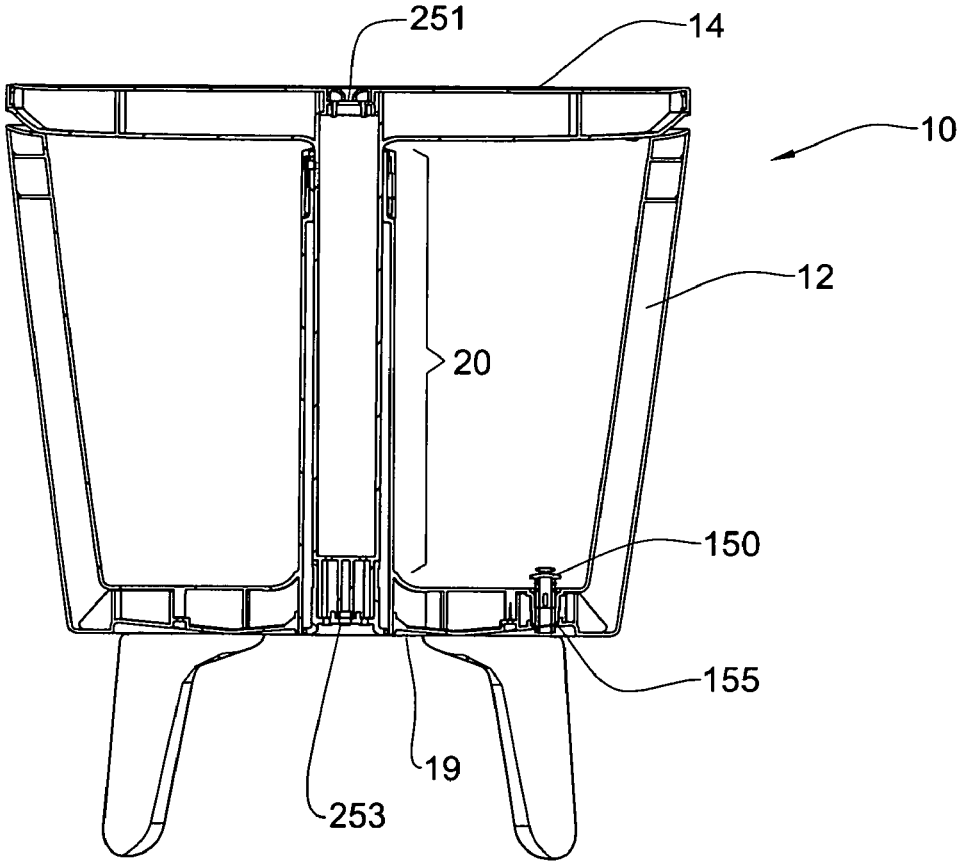
FIG. 12 is a longitudinal section of the cooler table according to variation of the invention, at a fully assembled, closed position.

According to a variation of the invention, illustrated in FIGS. 9A to 12, where for sake of clarity like elements are designated with like reference numerals, the cooler-table 10 comprises a draining port 155 at the bottom 19 thereof (best seen in FIG. 12). The draining port 155 is fitted with a movable sealing plug 150, which may be pushed by a user from underneath the cooler-table or pulled from the interior 24 thereof and thus allows draining of the liquid from within the cooler-table 10.

According to yet another variation of the invention, best seen in FIGS. 9A to 11, cooler table is provided with a draining channel having a top opening 251 on a table top 14 and an opposite opening 253 on a bottom 19 of the cooler-table 10. Such draining channel allows draining of fluid from the surface of the table top 14 in the direction of arrows 111 in FIG. 10 via the support post 20 and out through the opening 253.

Figure 5:
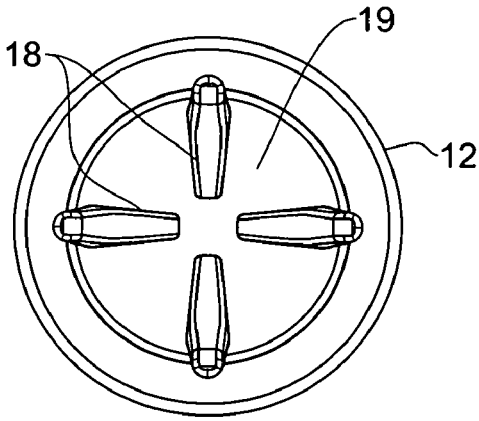
FIG. 5 is a bottom view of the cooler table in accordance with an embodiment of the present invention.

The support legs 18 are attached to a bottom surface 19 of the storage compartment by screw coupling of threaded stems 21 projecting from the legs and coupled into the base (as seen in FIG. 5). Alternatively, as illustrated for example in FIGS. 7*b* and 7C, legs 18A are attached to the base 19A by a snap-type engagement and for that purpose, the bottom surface 19A is fitted with respective receptacles 21 for supportingly receiving a portion of the legs 18A, and appropriate recesses 23 for snap engagement with projecting lugs 25 of the legs. It is appreciated that respective portions of the internal liner 12B rest over the leg receptacles 21, thus increasing rigidity of the structure and its durability to bear axial loads.

Figure 3:
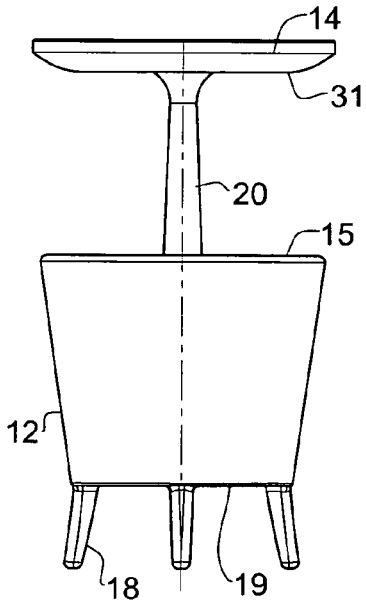
FIG. 3 is a side view of the cooler table at the position of FIG. 2.
Figure 7A:
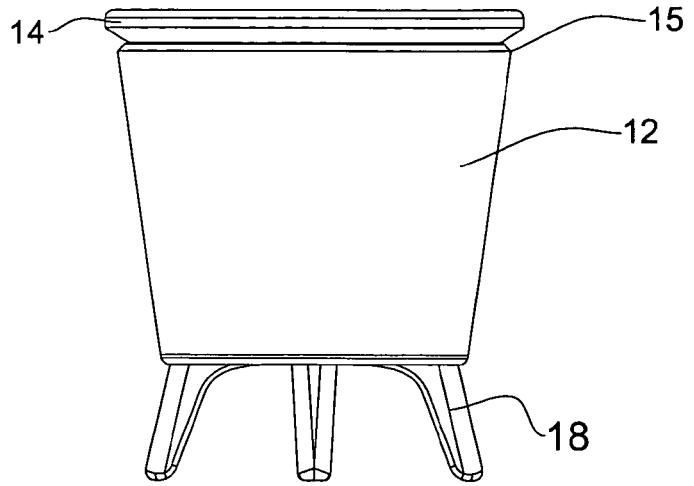
FIG. 7A is a side view of the cooler table at a sitting table position in accordance with an embodiment of the present invention.

According to still an embodiment of the present invention, the legs may be pivotally articulated to the base 19 such that they may be displaceable between an open position in which they extend as exemplified in FIGS. 2, 3, and 7A or a collapsed/folded position.

In the present embodiment and as can best be seen in FIGS. 4A, 4B, 6 and 7B, the support stem 20 is composed of a first stem member 20A and second stem member 20B telescopically displaceable within the first stem member. The first stem member 20A is integrally formed (typically during molding process) with the internal liner 12B. At the assembled position the second stem member 20B is screw coupled within the first stem member 20A via threads 27 and 31 of the first stem member 20A and the second stem member 20B, respectively. According to another example, there may be a snap-type engagement, between the two stem members. According to yet an example, the two stem members may be either threadably engaged or collapsed and extended through a piston. In addition, there may be provided a locking mechanism 90 (as exemplified in FIG. 9B), e.g. in the form of a locking ring, a retention member etc. to thereby prevent telescopic collapse of the second stem member 20B into the first stem member 20A. The table top 14 is screw coupled over the top end 35 of the second stem member 20B, as can best be seen in FIGS. 4B and 7B. However, the table top 14 may also be snappingly mounted over the second stem member 20B. According to a modification of the invention, (e.g. FIG. 10), the table top 14 and a second stem member 20B are formed as an integral unit.

It is noted that the lower stem member 20A does not exceed beyond a top edge 15 of the storage compartment. Still, at the stowed position of FIG. 1, or at the low-table semi-stowed position of FIG. 7A, the table top 14 rests over the top edge 15 of the storage compartment 12 and may further be secured over a top end 27 of the lower stem member 20A such that the table top 14 is secured to the storage compartment 12. By this arrangement the table top 14 may bear heavier loads and will not collapse as it is centrally supported. According to a modification of the invention, the rim of the table top 14 may further be provided with protuberance for increasing friction between the rim of table top and the top edge 15 of the storage compartment 12.

Figure 6:
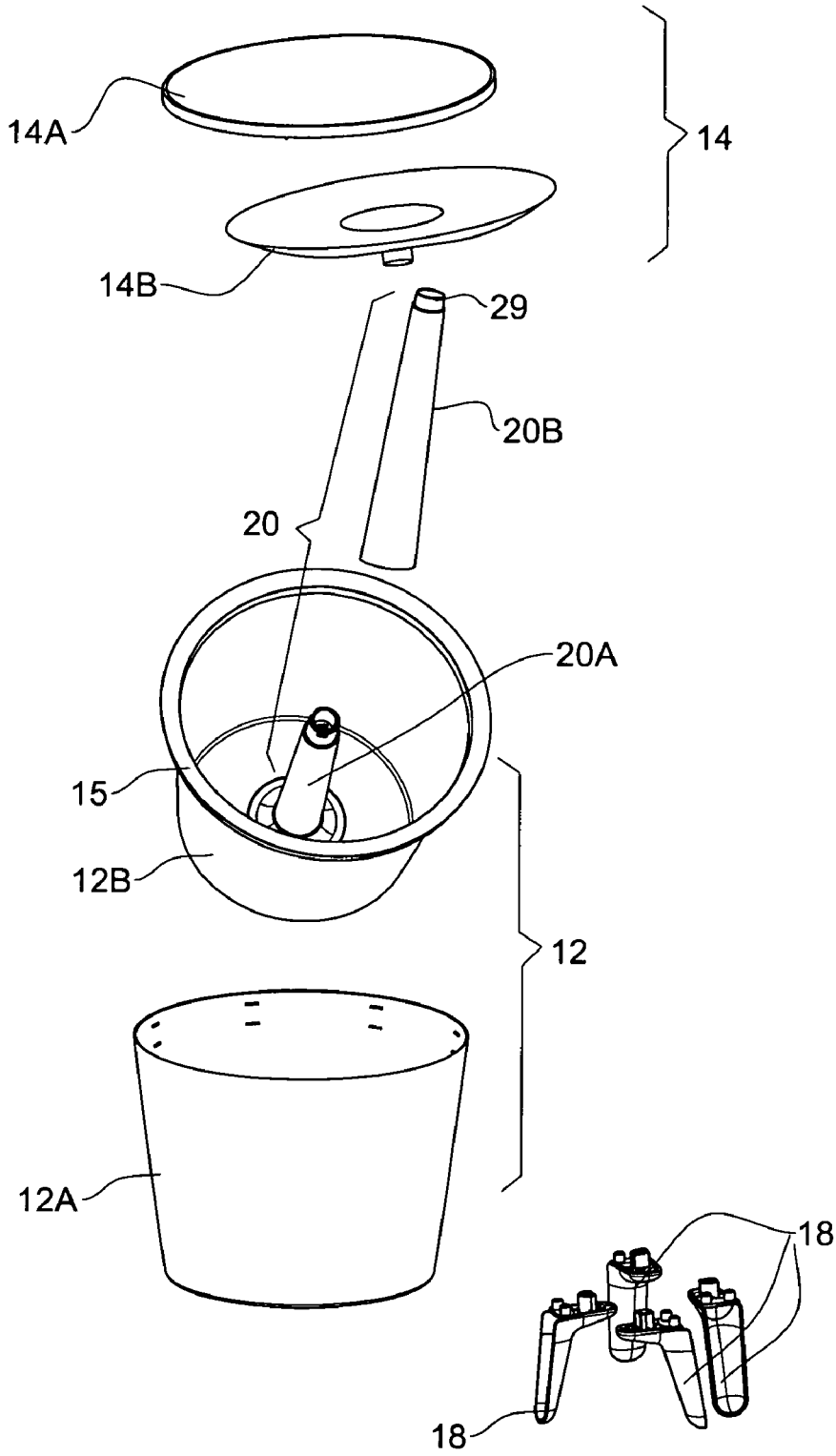
FIG. 6 is an exploded isometric view of the cooler table in accordance with one embodiment of the present invention.

As can be seen in FIG. 6, the table top 14 is composed of a top surface 14A and a bottom dish-like member 14B, snappingly or otherwise secured to one another, the latter being detachably attachable to a top end 29 of the upper stem member 20B.

The semi-stowed position of FIG. 7A (namely, telescopic stem 20 collapsed with table top 14 resting over storage compartment 12, however legs 18 still deployed) may be useful for sitting around the table and in this position the storage compartment 12 is closed and thermal isolation is maintained. Cover (table top) 14 must be first removed in order to allow access to the storage compartment 12.

Figure 7B:
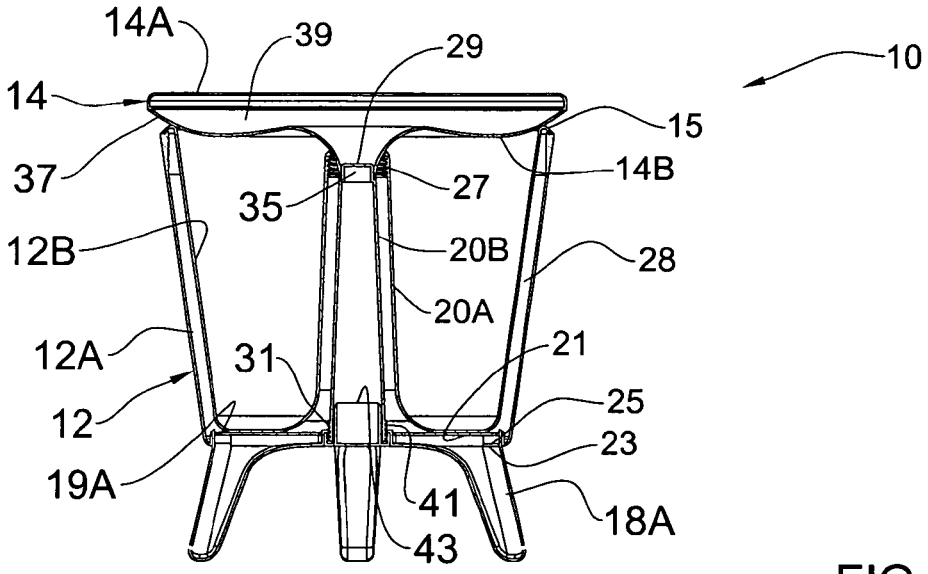
FIG. 7B is a longitudinal section of the cooler table of FIG. 7A.
Figure 7C:
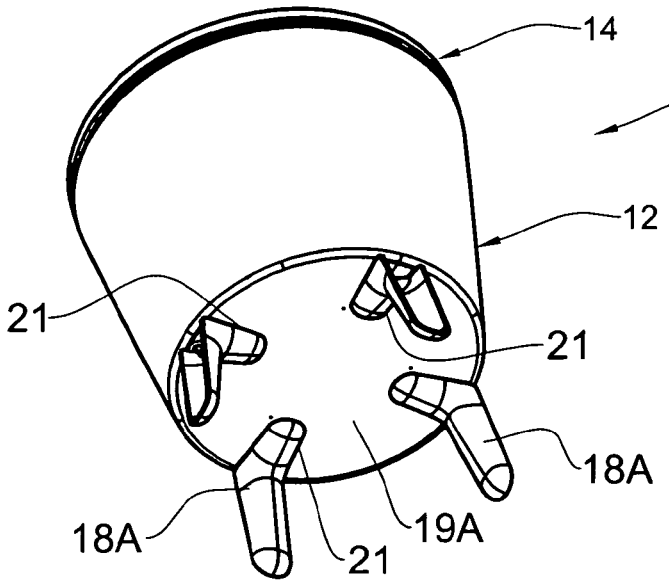
FIG. 7C is a bottom isometric view of the cooler table, at its fully assembled, closed position in accordance with an embodiment of the present invention.

Collapsing and stowing of the cooler table 10 requires disassembly of the support stem members 20A and 20B which are then telescopically positioned within the storage compartment as in FIG. 7B, with the table top 14 sealingly resting over the top edge 15 of the storage compartment 12.

As can further be seen in FIG. 7B at the collapsed position, a lower end 41 of the top stem member 20B is coaxially supported over an upwards projection 43 extending from the base of the storage compartment 12, thereby bearing axial loads acting on the table top 14 and retaining it centrally with respect to the opening of the storage compartment 12, e.g. at the event of a load resting over the table top 14.

The support legs 18 may be detached from the base 19 of the storage compartment 12 and also inserted into the storage compartment at the position of FIG. 1 where the cooler table 10 assumes a minimal volume with all its components stowed therein. In this position, like cooler tables may be conveniently stacked on top of each other for shipping and storage purposes. Alternatively, the legs 18 are folded into their collapsed, pivoted position as in FIG. 5, or the legs may be altogether detachable.

As can further be noted in the drawings, the bottom dish-like element 14B is formed at its lower perimeter with a tapering annular portion 37 in order to facilitate engagement over the top edge 15 of the storage compartment 12 and allow sealing and thermal isolation. Alternatively, the bottom dish-like element 14B may be formed with an annular rim corresponding for sealing engagement with the top edge 15 of the storage compartment 12. Evenmoreso, there may be provided a resilient sealing member for enhancing sealing therebetween.

Figure 4B:
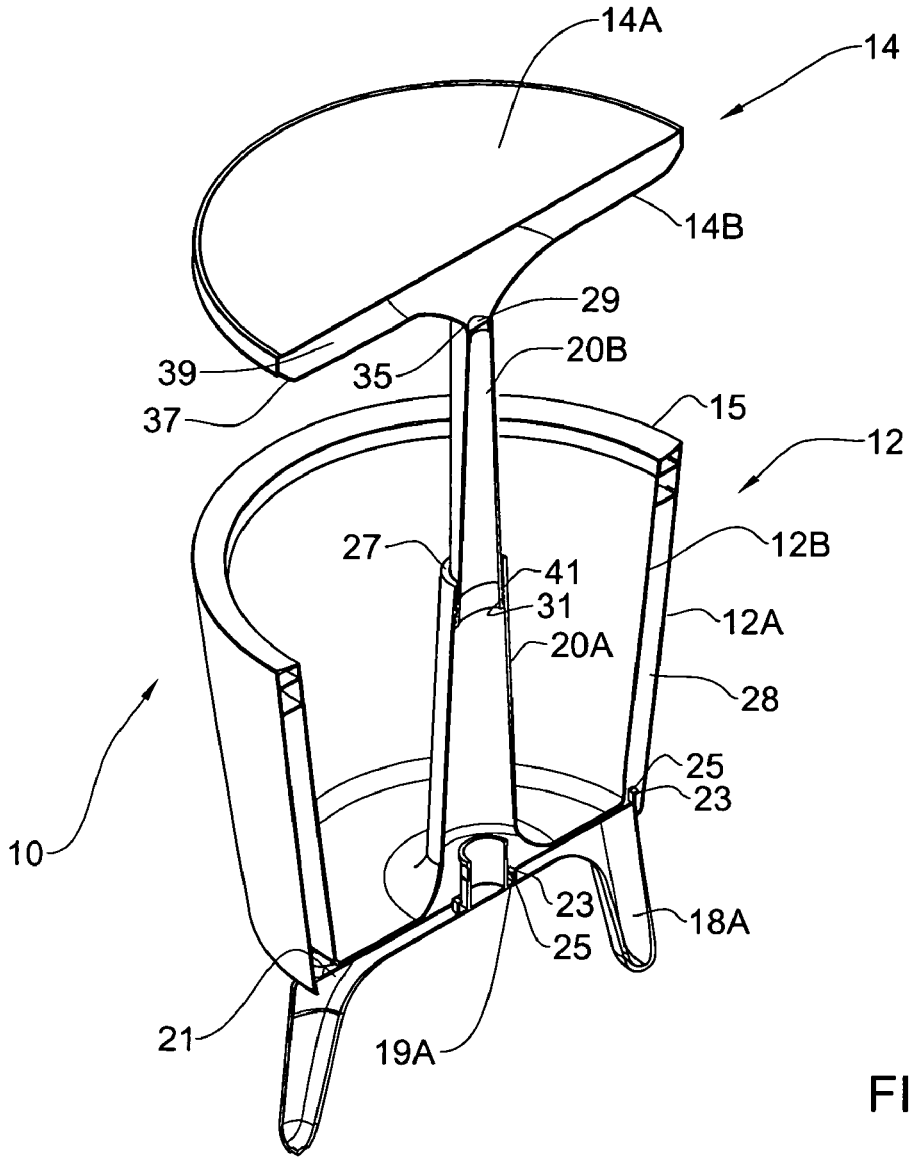
FIG. 4B is a sectioned isometric view of an embodiment of the cooler table of FIG. 2.

Furthermore, it is appreciated that the table top 14 is assembled such that a sealed space 39, as can be seen in FIGS. 4B and 7B, extends between the two table top components 14A and 14B, thus improving thermal isolation when the cooler table is at its closed position, to thereby retain articles stored therein at their temperature (chilled or warm). Space 39 may be a filled with a thermally isolating agent or may be an air tight space.

Figure 8:
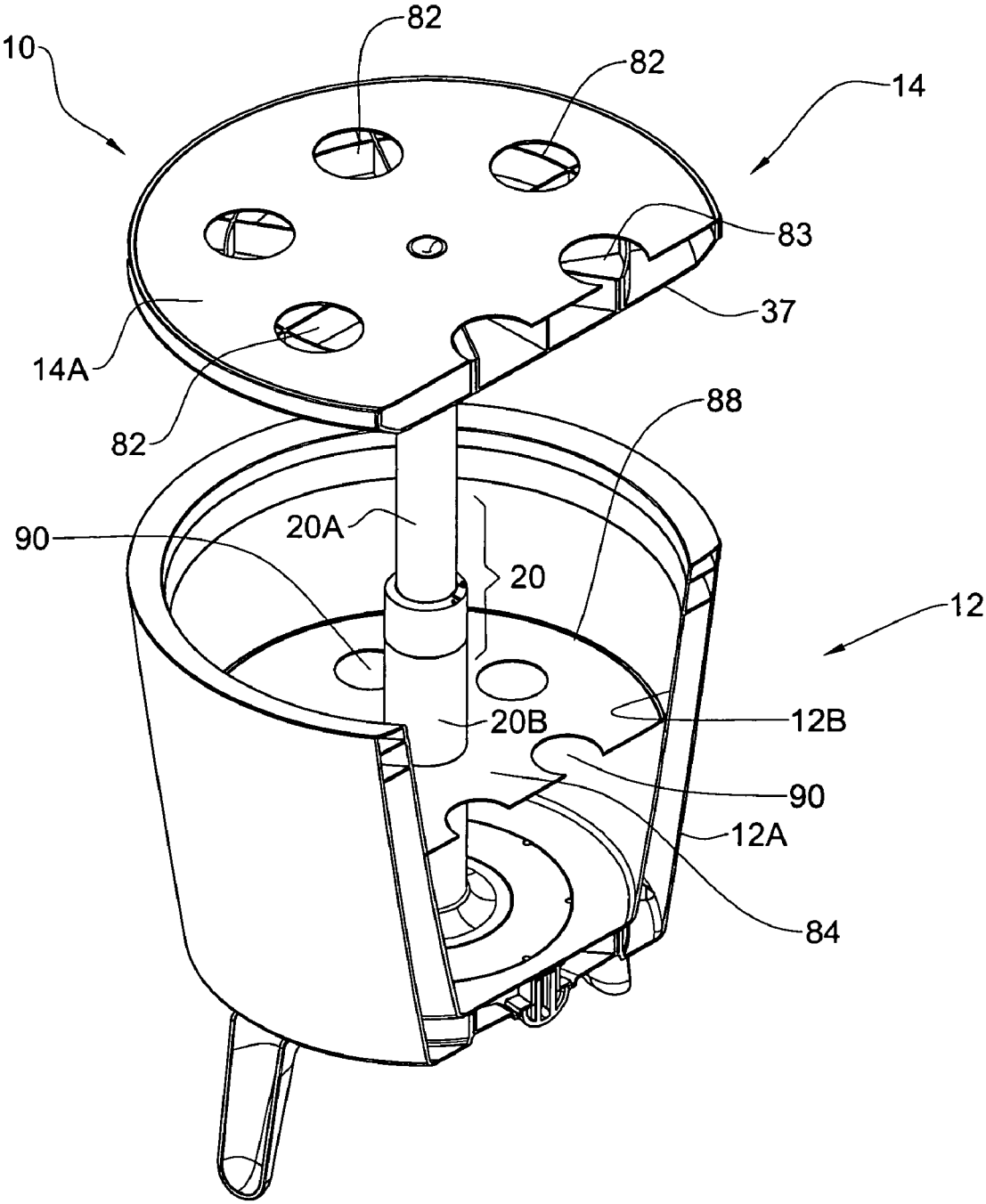
FIG. 8 is an isometric, longitudinally offset section of a cooler table according to a variation of the invention, at its deployed position.
Figure 9A:
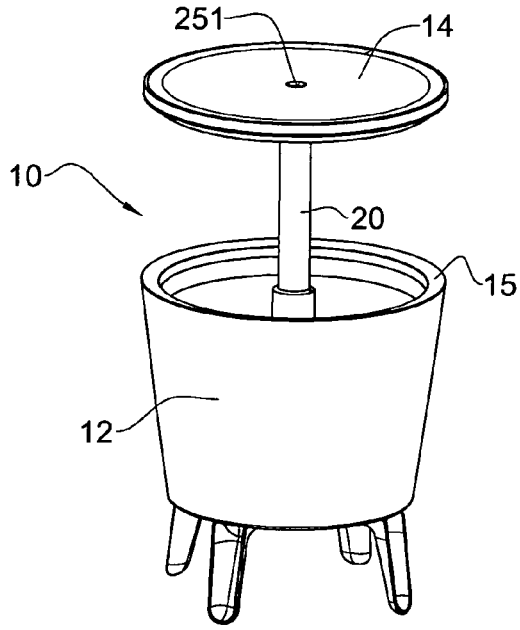
FIG. 9A is an isometric view if the cooler table according to variation of the invention at a fully open, standing table position.
Figure 10:
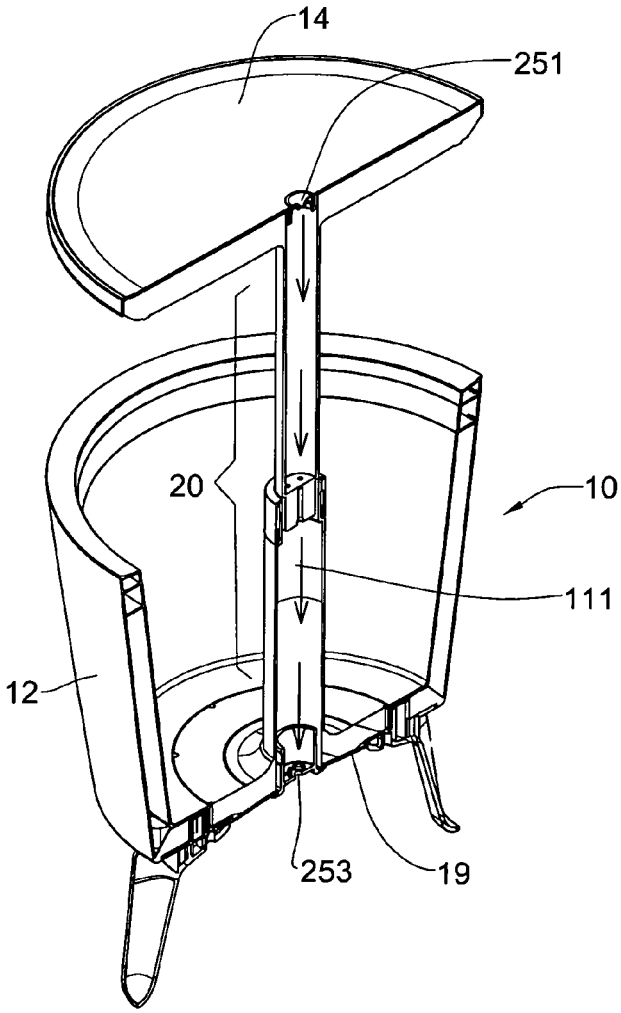
FIG. 10 is a sectioned isometric view of an embodiment of the cooler table of FIG. 9A.
Figure 9B:
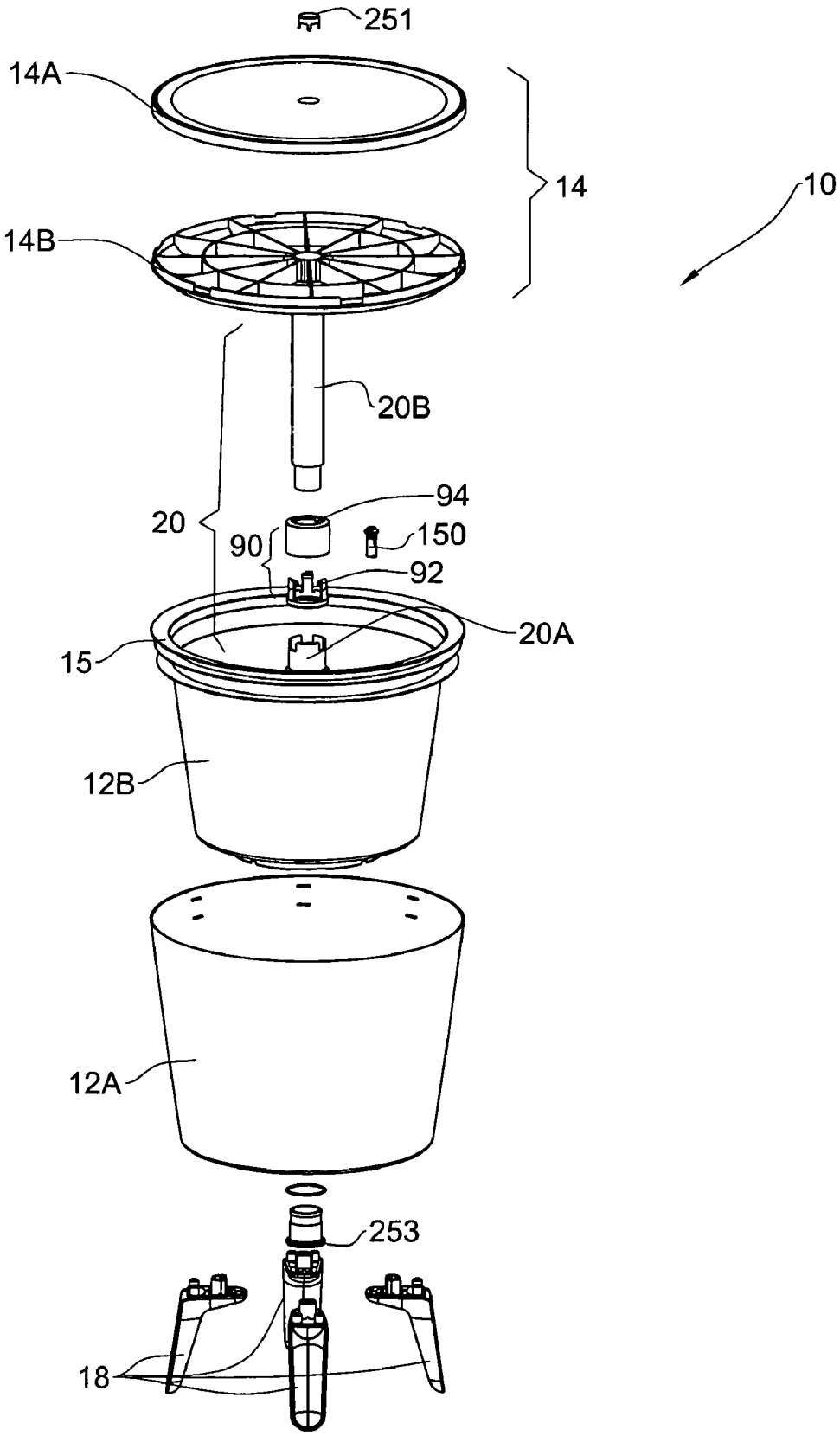
FIG. 9B is an exploded isometric view of the cooler table of FIG. 9A.
Figure 11:
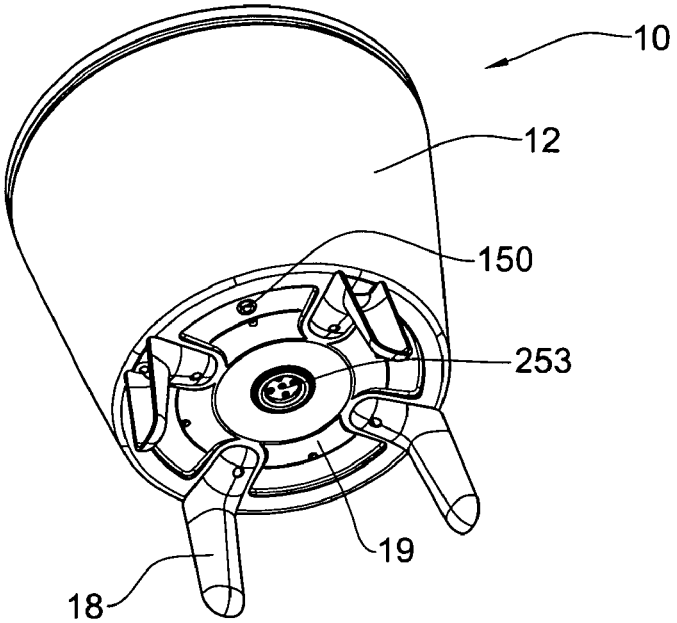
FIG. 11 is a bottom isometric view of the cooler table of FIG. 10, at its fully assembled, closed position.

With further reference to FIG. 8 there is illustrated a modification of the invention where for sake of clarity like elements are designated with like reference numbers. In the embodiment of FIG. 8 it is noted that the table top 14 is formed with a plurality of glass/bottle receptacles in the form of indentions 82. Furthermore, there is a bottle support 84 received within the storage compartment 12, in the form of a ring fitted with a central opening resting over the lower stem member 20B and with its peripheral edge 88 bearing against the inner liner 12B, whereby it is prevented from descending. The bottle support 84 is formed with a plurality of openings 90 to support bottles at an upright position. It is appreciated that the ring also increases support of the post member 20B.

The components of the cooler table are advantageously made of a light-weight material, e.g. durable plastic material, typically in a molding process and at a variety of colors. Different additives may be added such as for increasing UV resistance, etc. According to yet an example, some or all components of the cooler table may be made from metal material, wood etc.

In accordance with a further modification of the invention (not shown), the cooler-table is provided with an AC/DC power unit, built in fan and/or a set-point thermostat for cooling/warming the content of the cooler-table. The power source may be adapted to plug into vehicle's DC outlet or AC power outlet.

Those skilled in the art to which this invention pertains will readily appreciate that numerous changes, variations and modifications can be made without departing from the scope of the invention mutatis mutandis.

The invention claimed is:

1. A cooler table comprising:

a storage compartment formed with a top edge; and a tabletop, said tabletop being manipulable between a closed lower position in which it closes said top edge, and a table upper position in which it is mounted on a post extending from said storage compartment serving as a table whilst allowing access to said storage compartment, wherein the cooler table has a top drain opening on the tabletop and an opposite opening on a bottom of the storage compartment and a drain channel extending therebetween.

2. A cooler table according to claim 1, wherein at least the storage compartment is thermally isolated.

3. A cooler table according to claim 1, wherein at the table position the tabletop extends at a height rendering the table a bar-type table.

4. A cooler table according to claim 1, wherein all components thereof are receivable within the storage compartment when the tabletop is at the closed position.

5. A cooler table according to claim 1, wherein the storage compartment is fitted at a bottommost portion thereof with at least one drain port.

6. A cooler table according to claim 1, wherein the storage compartment is provided at its bottom with a drain port fitted with a movable sealing plug.

7. A cooler table according to claim 1, wherein the drain channel extends through the post extending between the tabletop and the storage compartment.

8. A cooler table according to claim 1, wherein the storage compartment is double-walled to thereby form a thermally isolating space.

9. A cooler table according to claim 1, wherein the tabletop is mountable on an extendible central post extending from the storage compartment.

10. A cooler table according to claim 9, wherein the post extends from an inside liner of the storage compartment.

11. A cooler table according to claim 10, wherein the post is radially supported to side walls of the storage compartment.

12. A cooler table according to claim 10, wherein the post is telescopically extendible.

13. A cooler table according to claim 10, wherein the post is constructed from two or more detachably attachable segments.

14. A cooler table according to claim 10, wherein the post is constructed from two or more detachably attachable segments, wherein a first segment is integral with the storage compartment.

15. A cooler table according to claim 10, wherein the second segment is integral with the tabletop.

16. A cooler table according to claim 8 wherein the isolated storage compartment is established of two coaxial shell-like members which at an assembled position define between them an air-isolation space.

17. A cooler table according to claim 1, being a coaxial structure.

18. A cooler table according to claim 1, having a cylindrical structure.

19. A cooler table according to claim 1, wherein a plurality of support legs are detachably attachable or collapsibly attached to a bottom base of the storage compartment, for elevating the cooler table.

20. A cooler table according to claim 19, wherein a thermally isolating agent is applied in the space.

21. A cooler table according to claim 1, being stackable over a like cooler table, wherein a base of a storage compartment of one cooler table fits over a tabletop of another cooler table.

* * * * *